US008210087B2

(12) United States Patent
Latka

(10) Patent No.: US 8,210,087 B2
(45) Date of Patent: Jul. 3, 2012

(54) APPARATUS AND METHOD FOR SECURING A SUPPRESSOR TO A WEAPON

(76) Inventor: Gregory S. Latka, Jackson, MI (US)

( * ) Notice: Subject to any disclaimer, the term of this patent is extended or adjusted under 35 U.S.C. 154(b) by 287 days.

(21) Appl. No.: 12/503,165

(22) Filed: Jul. 15, 2009

(65) Prior Publication Data

US 2012/0103176 A1 May 3, 2012

Related U.S. Application Data

(60) Provisional application No. 61/135,086, filed on Jul. 16, 2008.

(51) Int. Cl.
*F41A 21/36* (2006.01)

(52) U.S. Cl. ..... 89/14.3; 89/14.4

(58) Field of Classification Search ..... 89/14.3, 89/14.4

See application file for complete search history.

(56) References Cited

U.S. PATENT DOCUMENTS

| | | | | |
|---|---|---|---|---|
| 3,710,679 | A * | 1/1973 | Werbell, III | 89/14.4 |
| 4,479,418 | A | 10/1984 | Beretta | |
| 4,893,426 | A * | 1/1990 | Bixler | 42/75.01 |
| 4,939,977 | A | 7/1990 | Stroup | |
| 5,559,302 | A * | 9/1996 | Latka | 89/14.05 |
| 6,412,389 | B2 | 7/2002 | Fluhr | |
| 6,701,820 | B2 | 3/2004 | Fluhr | |
| 6,973,863 | B1 * | 12/2005 | Jones | 89/14.2 |
| 7,062,874 | B1 | 6/2006 | Smith | |
| 7,207,258 | B1 | 4/2007 | Scanlon | |
| 2006/0123983 | A1 * | 6/2006 | Vais | 89/14.3 |
| 2007/0044645 | A1 * | 3/2007 | Fuss et al. | 89/1.13 |

* cited by examiner

*Primary Examiner* — Stephen M Johnson

(74) *Attorney, Agent, or Firm* — Young Basile Hanlon & MacFarlane P.C.

(57) ABSTRACT

The invention is an adapter and a method for securing a silencer/suppressor to the barrel of a firearm. The invention incorporates a uniformly deformable spring washer positioned within a cavity within the adapter. The cavity communicates with an opening in the silencer/suppressor into which the discharge end of the barrel of the firearm is fitted. As the silencer/suppressor is secured to the discharge end of the barrel of the weapon, the uniformly deformable spring washer is deformed uniformly, locking the silencer/suppressor together with the barrel of the weapon, and preventing the silencer/suppressor from separating from the barrel.

5 Claims, 3 Drawing Sheets

APPARATUS AND METHOD FOR SECURING A SUPPRESSOR TO A WEAPON

PRIORITY CLAIM

This application claims the benefit of U.S. Provisional Application No. 61/135,086, filed Jul. 16, 2008.

FIELD OF THE INVENTION

The present invention relates to a device and method for securing a suppressor/silencer to the barrel of a weapon, such as a firearm.

BACKGROUND OF THE INVENTION

It is well known to attach flash suppressors and noise-muffling devices (referred to as silencers) to the discharge end of the barrel of a firearm, such as a rifle or a handgun. It is desirable that the suppressor/silencer assembly be easily and quickly attached to and removed from the weapon, since the use of the suppressor/silencer is advantageous in some applications, and disadvantageous in others.

A number of systems have been developed for attachment of suppressors/silencers to rifle barrels, for example. Typically, the rifle barrel and the associated suppressor/silencer may be provided with mating threads. In other schemes, the suppressor/silencer and barrel may be provided with mating bayonet-type fittings which allow the suppressor/silencer to be attached quickly without multiple rotations of the silencer to the rifle barrel.

Regardless, however, of how the suppressor/silencer is secured to the rifle barrel, a common problem exists in maintaining a secure engagement between the rifle barrel and the suppressor/silencer. Because of the enormous forces and pressures associated with the discharge of firearm projectiles through a rifle bore and its associated suppressor/silencer, substantial vibrations may occur during the simple firing of the weapon which tends to cause the suppressor to become disengaged from the rifle barrel. Additionally, when the weapon to which a suppressor/silencer is attached is subjected to the ordinary jarring of transport and handling, or the use of such weapons in a combat environment, additional forces and vibrations can tend to cause the suppressor/silencer to loosen from the rifle barrel, even when the rifle is not being fired. In either event, it is desirable that a secure locking engagement exists between the rifle barrel and the suppressor/silencer.

It is critical that the suppressor/silencer remain tightly secured to the host weapon. If the suppressor/silencer is permitted to loosen in relation to the muzzle of the host weapon, the suppressor/silencer may become no longer concentrically aligned with the centerline of the host weapon's barrel. Such misalignment can cause projectiles exiting the weapon's barrel to impact the internal baffles or other components of the suppressor/silencer. This may result in only minor deformation of the components, but may also result in catastrophic failure of internal portions of the suppressor/silencer. The results of these types of failures can range from degraded performance of the suppressor/silencer to serious injury or death to the weapon's operator.

In the past, a number of techniques have been applied to the securement of a suppressor/silencer to a gun barrel. By way of example, U.S. Pat. No. 7,207,258, to Scanlon, teaches a silencer for a weapon which is threadably secured to the outer circumference of the discharge end of the gun barrel. A threadable connection is provided on the silencer to engage with threads on the end of the barrel. Beretta, in U.S. Pat. No. 4,479,418, teaches an apparatus for attaching a silencer to a firearm utilizing a plurality of sliding elements which engage the silencer adaptor to the frame of the weapon, without threadable means. Fluhr, in U.S. Pat. No. 6,701,820, teaches a method and apparatus for attaching a silencer to a firearm utilizing a spring-mounted cross slide which engages a groove in the outer surface of the barrel. Other efforts to secure the suppressor/silencer to the rifle barrel have utilized traditional lock washers, such as that taught by Stroup in U.S. Pat. No. 4,939,977. The difficulty associated with this type of engagement, however, is the tendency of conventional split lock washers to tilt the bore of the suppressor/silencer in relation to the rifle barrel. Additionally, the lock washer taught by Stroup is not captive, easily becoming lost or misplaced when the suppressor/silencer is removed from the rifle barrel.

The present invention is designed to overcome these limitations.

SUMMARY OF THE INVENTION

The present invention solves the above problems by providing a self-locking condition between the suppressor/silencer and the host weapon. This locking system prevents the suppressor/silencer from loosening during the firing of the weapon. The desired result is accomplished by the use of a compression member which, when compressed, exerts an axial force inline with the host weapon's barrel that acts to engage the suppressor/silencer's attachment means with the host weapon's attachment means. By nature of the compression member, the forces exerted are equal and opposite, effectively placing the combination of the host weapon and the installed suppressor/silencer in tension. The opposing force factors act upon the attachment means of the system to create additional friction for mating the two elements of the system together.

This additional friction increases the required torque or moment required to detach and reattach the suppressor/silencer from the muzzle of the host weapon.

DETAILED DESCRIPTION OF THE DRAWINGS

DESCRIPTION OF THE PREFERRED EMBODIMENT

Figure 1:
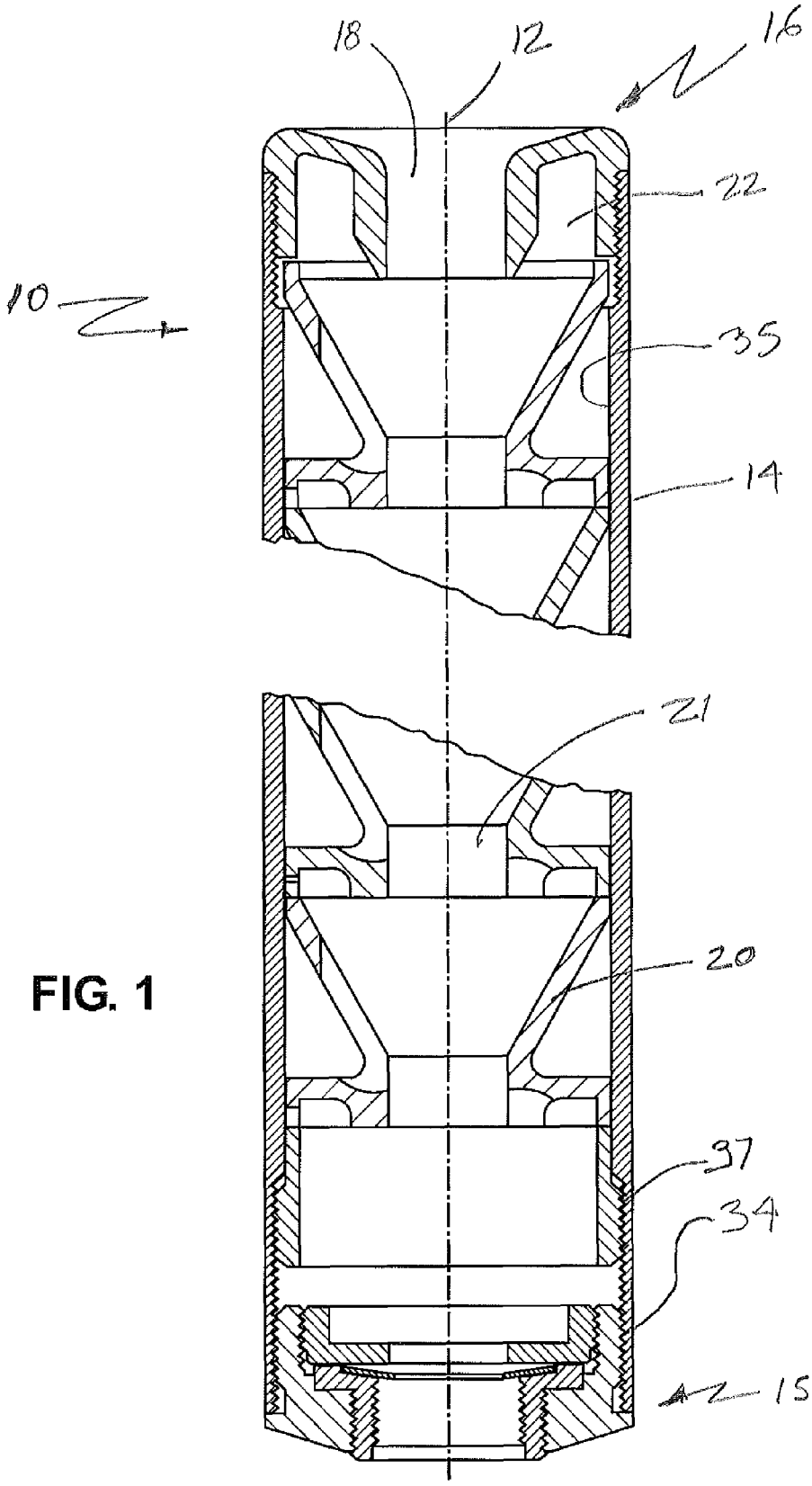
FIG. 1 is a split cross-section displaying the muzzle end and discharge end of a suppressor/silencer utilizing the present invention.
Figure 2:
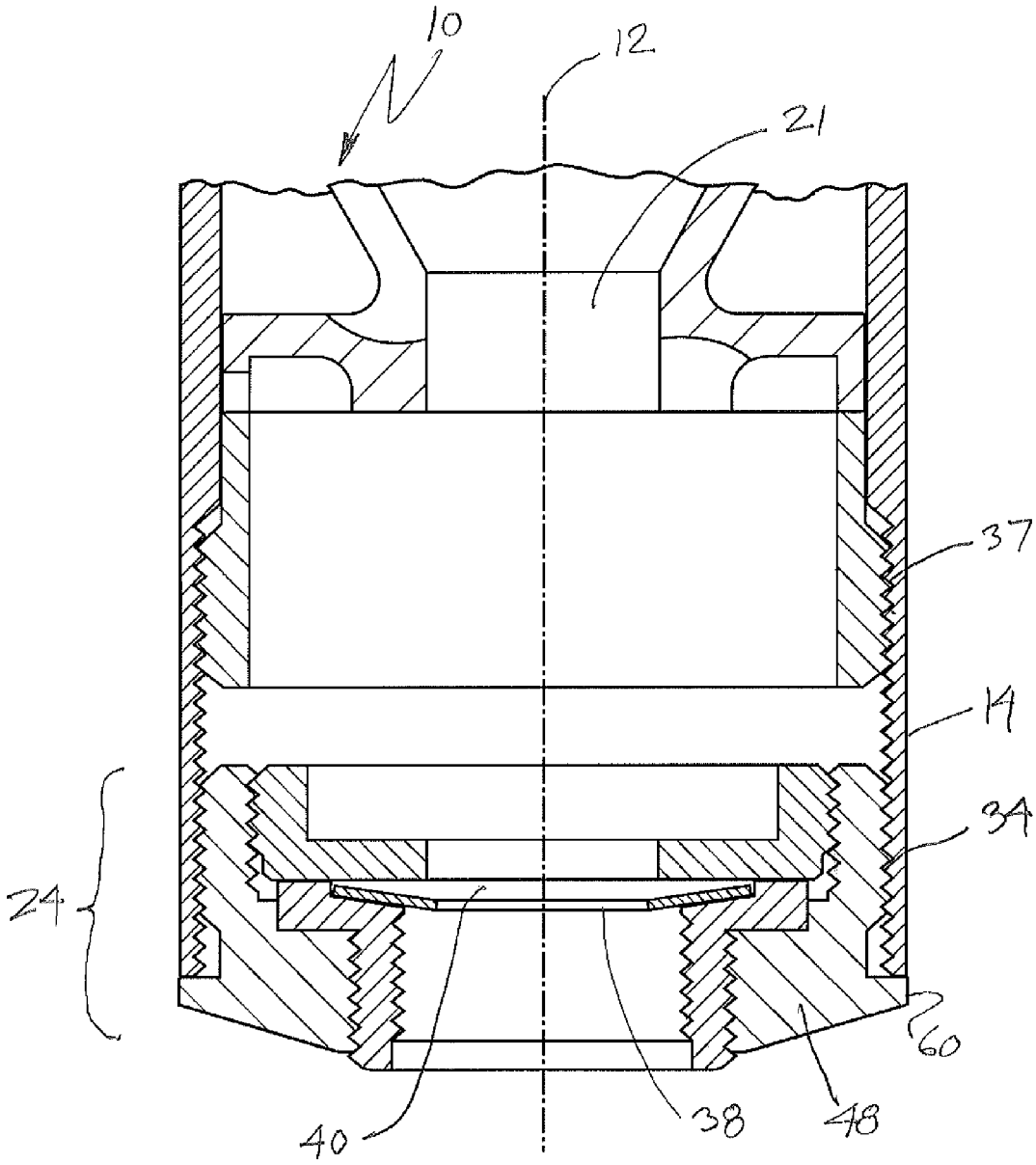
FIG. 2 is a larger scale cross-section of the muzzle end of a suppressor/silencer utilizing the present invention.
Figure 3:
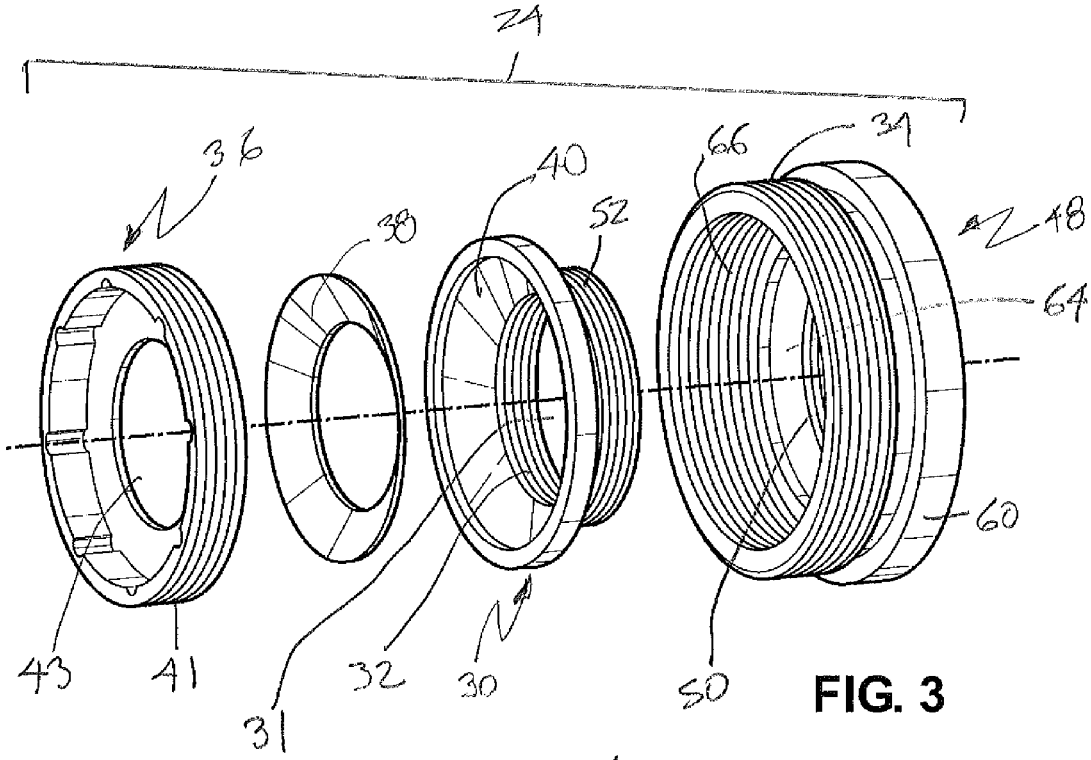
FIG. 3 is an exploded perspective view of the invention showing the components thereof.
Figure 4:
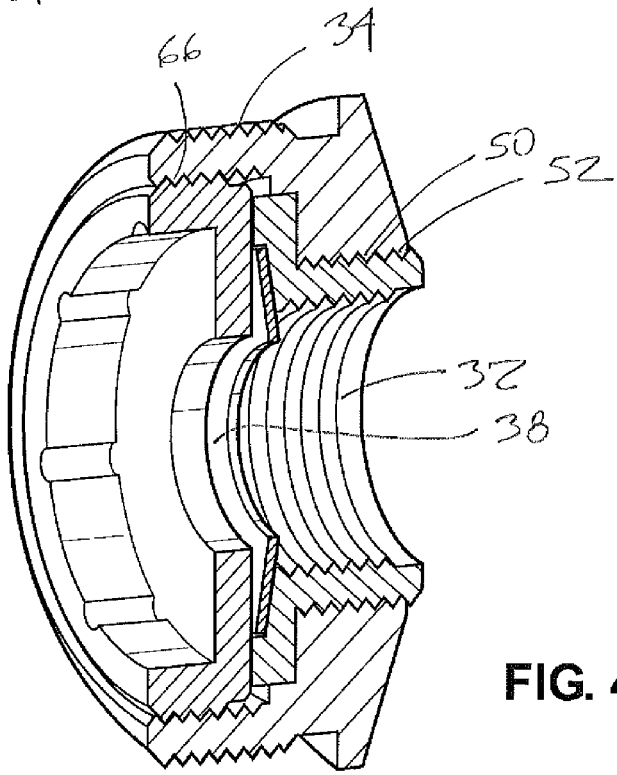
FIG. 4 is a cutaway perspective view of the assembled invention showing the various components thereof.

The invention will best be understood by reference to the following detailed description, with additional reference to FIGS. 1-4 as above described.

In a typical application of the invention, a suppressor/silencer assembly 10 is provided for removable attachment to a muzzle of a firearm (not shown). In one embodiment, the suppressor/silencer 10 includes a muzzle end 15, a discharge end 16, and a bore 18 having a centerline 12. A typical suppressor/silencer assembly is conventionally a cylindrical tube fabricated from high strength material, such as steel. Disposed within the cylindrical outer wall 14 of the suppressor/silencer 10 are a plurality of baffles 20 which are specifically designed to capture and dampen the pressure released when the firearm is discharged, as well as to absorb the bi-products of the combustion of the gunpowder ejected from the muzzle of the weapon. The baffles feature coaxially aligned openings 21, which, in turn, are coaxially aligned with the centerline 12 of the bore 18, to insure that the projectile discharge from the weapon passes cleanly through the suppressor/silencer 10 without physical contact with any portion of the baffles 20 or the openings 21 in baffles 20. An expansion chamber 22 is disposed proximate the muzzle end 15 and the suppressor/silencer, to accommodate the initial expansion of discharge gases from the weapon and to facilitate the distribution of those gases and pressures throughout the baffles 20 of the suppressor/silencer 10.

The present invention comprises an adaptor assembly 24 secured to the muzzle end 15 of the suppressor/silencer 10.

In one embodiment, the interior wall 35 of the suppressor/silencer 10 is provided with internal threads 37. The adaptor assembly 24 is provided with mating external threads 34, allowing the adaptor assembly 24 to be threadably inserted into the muzzle end 15 of the suppressor/silencer 10. Preferably, the interior wall internal threads 37 are locked into engagement with external threads 34 of adaptor assembly 24 utilizing thread-locking compound, or, in the alternative, a setscrew or similar locking device which prevents unscrewing of the adaptor assembly 24 from the suppressor/silencer 10. The adaptor 24 is comprised of four main components, threaded body 48, 30 spring washer 38 and retainer 36.

Threaded body 48 is generally annular in shape, and features a threaded bore, and is provided with internal threads 50, external threads 34, a cylindrical cavity 64 and a shoulder 60. The shoulder 60 of threaded body 48 is provided to engage the lower periphery of the outer wall 14 of suppressor/silencer 10.

Disposed within cylindrical cavity 64 are cavity threads 66.

A threaded insert 30 is provided with external threads 52 which engage the internal threads 50 of the cylindrical cavity 64. Once threaded insert 30 has been threadably inserted into cylindrical cavity 64, threaded insert 30 may be permanently locked into alignment within cylindrical cavity 64 through the use of a fixing pin (not shown). Threaded insert 30 is also provided with internal threads 32, bore 31 and an annular spring cavity 40.

In the present invention, a uniformly deformable spring washer 38, such as a Belleville washer is provided having an outer diameter nominally smaller than the outer diameter of the annular spring cavity 40 of threaded insert 30. The spring washer 38, accordingly, is partially captured within spring cavity 40, and inhibited from movement perpendicular to bore centerline 12 by the circumferential walls of the cavity 40.

Retainer 36 is an annular member, provided with external threads 41 engageable with the cavity threads 66 of cylindrical cavity 64 of threaded body 48. Retainer 36 is also provided with a bore opening 43 equal to or larger in size than the bore of the weapon to which the suppressor/silencer is attached. As the retainer 36 is inserted and tightened into position within the cylindrical cavity 64, of threaded body 48, spring washer 38 is captured and inhibited from axial movement. The bottom surface of retainer 36 serves to define a cap for cavity 64. The components as above described, thereby defining a shallow annular spring cavity 40 within which spring washer 38 is captured. The annular spring cavity 40 so created is dimensionally selected so as to provide room for spring washer 38 to be compressed.

In the described embodiment, the adaptor assembly 24 as above described is assembled and secured within the muzzle end 15 of the suppressor/silencer 10. The internal threads 32 of the threaded insert now joined with adaptor assembly 24 engage external threads provided on the muzzle of the firearm to which the suppressor/silencer is to be attached. As the distal end of the muzzle of the firearm enters the threaded bore 31 of the insert 30, the suppressor/silencer 10 and muzzle of the weapon may be threadably engaged. As the suppressor/silencer 10 is rotated and hence tightened onto the muzzle of the weapon, the distal end of the muzzle of the weapon is brought into engagement with the spring washer 38. Further tightening of the suppressor/silencer 10 in relation to the gun barrel muzzle results in compression of spring washer 38, thereby exerting tension between the suppressor/silencer 10 and the weapon's muzzle. The spring washer 38, as it is compressed, increases the drive friction on the engaged threads 32 of the adaptor 24 and the muzzle of the weapon. The friction forces act not only within the engaged threads of the system, but also the end of the muzzle where the compression spring washer 38 acts. This additional friction complements the increased friction within the engaged threads to further resist the torque or moment exerted on the suppressor/silencer 10 by the firing of the host weapon.

Although in the present embodiment, a Belleville-type washer is depicted, suitable additional compression members, such as disc springs, wave springs or compressions springs, or any combination thereof, may be incorporated.

Although certain examples have been described herein, the patent is not intended to be limited to those examples, but is defined by the claims as follows:

The invention claimed is:

1. In an adaptor for coupling a silencer/suppressor to the discharge end of the barrel of a weapon, the improvement comprising:

an annular cavity disposed within said adapter, a uniformly deformable spring washer disposed within said annular cavity, whereby engagement of said adaptor with said discharge end of said barrel of said weapon deforms said spring washer by direct contact between said spring washer and said discharge end of said barrel.

2. The apparatus of claim 1, wherein said uniformly deformable spring washer further comprises a Belleville washer.

3. A silencer/suppressor for a firearm having a barrel, said silencer/suppressor comprising:

an adapter couplable to the discharge end of said barrel of said firearm, an annular cavity disposed within said adaptor, a uniformly deformable spring washer disposed with said annular cavity, whereby engagement by said adapter with said discharge end deforms said spring washer by direct contact between said spring washer and said discharge end of said barrel.

4. The apparatus of claim 3, wherein said uniformly deformable spring washer is a Belleville washer.

5. The apparatus of claim 3, wherein said uniformly deformable spring washer is a wave spring washer.

* * * * *